US009223236B2

(12) United States Patent
Qiu et al.

(10) Patent No.: US 9,223,236 B2
(45) Date of Patent: Dec. 29, 2015

(54) PREPARING COLORANT DISPERSIONS USING ACOUSTIC MIXING

(71) Applicant: Xerox Corporation, Norwalk, CT (US)

(72) Inventors: Shigang Qiu, Toronto (CA); Santiago Faucher, Oakville (CA); Kimberly D Nosella, Mississauga (CA); David R Kurceba, Hamilton (CA); Yulin Wang, Oakville (CA); Karina Lopez, Richmond Hill (CA)

(73) Assignee: Xerox Corporation, Norwalk, CT (US)

( * ) Notice: Subject to any disclaimer, the term of this patent is extended or adjusted under 35 U.S.C. 154(b) by 377 days.

(21) Appl. No.: 13/782,772

(22) Filed: Mar. 1, 2013

(65) Prior Publication Data

US 2014/0248558 A1 Sep. 4, 2014

(51) Int. Cl.

| | |
|---|---|
| ***B01F 3/12*** | (2006.01) |
| ***G03G 9/08*** | (2006.01) |
| *B01F 15/00* | (2006.01) |
| *B01F 11/02* | (2006.01) |

(52) U.S. Cl.

CPC ..... *G03G 9/0804* (2013.01); *G03G 9/0812* (2013.01); *B01F 3/1242* (2013.01); *B01F 11/02* (2013.01); *B01F 11/0291* (2013.01); *B01F 15/00324* (2013.01); *B01F 15/00331* (2013.01)

(58) Field of Classification Search

CPC .. B01F 11/0266; B01F 11/0088; B01F 11/02; B01F 11/0291; B01F 3/1242; B01F 15/00324; B01F 15/00331

USPC ..... 366/108, 116

See application file for complete search history.

(56) References Cited

U.S. PATENT DOCUMENTS

| | | | | |
|---|---|---|---|---|
| 6,207,339 | B1 * | 3/2001 | Kato et al. | 430/137.15 |
| 6,544,321 | B1 * | 4/2003 | Sweeney et al. | 106/31.27 |
| 2006/0029878 | A1 * | 2/2006 | Yoshizawa et al. | 430/124 |
| 2009/0069476 | A1 * | 3/2009 | Stork et al. | 524/301 |
| 2009/0111040 | A1 * | 4/2009 | Veregin et al. | 430/108.3 |
| 2010/0239972 | A1 * | 9/2010 | Kim et al. | 430/109.2 |
| 2012/0288793 | A1 * | 11/2012 | Kim et al. | 430/137.14 |
| 2014/0248558 | A1 * | 9/2014 | Qiu et al. | 430/137.1 |

* cited by examiner

*Primary Examiner* — Tony G Soohoo

(57) ABSTRACT

The present disclosure provides processes for making inorganic or organic colorant dispersions using an acoustic mixer, where such dispersion may be used to make toner. Such processes apply low frequency, high intensity acoustic energy and a consistent shear field throughout an entire mixing vessel and provide uniform dispersion of colorants within minutes.

20 Claims, No Drawings

PREPARING COLORANT DISPERSIONS USING ACOUSTIC MIXING

BACKGROUND

The present disclosure relates to processes for producing pigment dispersions useful in making toner suitable for electrostatographic apparatuses.

Numerous processes are within the purview of those skilled in the art for the preparation of toners. Emulsion aggregation (EA) is one such method.

Typically, the colorants utilized in EA toner processes are in aqueous dispersions in which colorant particles are stabilized by surfactant and dispersed in water. Such colorant dispersions may be made using a high pressure piston-type homogenizer, (e.g., an Ultimaizer) generally yielding dispersions having fine particle size distribution, stabilized, for example, with sodium dodecylbenzene sulfonate surfactant. However, that approach has limitations in capacity and carries a high capital cost. Other methods may include using an in-line rotoristator-type homogenizer which requires less capital investment and maintenance. However, the process can exceed four hours to obtain colorant for making toner.

There remains a need to develop a dispersion technology which reduces processing time and cost, without sacrificing benchmark material properties (e.g., small size and narrow particle size distribution).

SUMMARY

The present disclosure provides processes for making colorant dispersions using an acoustic mixer, where such processes apply low frequency, high intensity acoustic energy and consistent shear field throughout an entire vessel to provide uniform dispersion of materials within minutes instead of hours.

In embodiments, a process is disclosed including mixing one or more colorants, a dispersant and water in a vessel and subjecting the mixture to acoustic mixing at a frequency of from about 3 Hertz to about 300 Hertz to form a uniform pigment dispersion, where particles have a $D_{50}$ of from about 50 nm to about 500 nm.

In embodiments, a standard deviation of such a $D_{50}$ particle size diameter distribution is from about 0.03 to about 0.3.

In embodiments, a process is disclosed including combining a colorant, a dispersant, such as, an anionic surfactant and water, mixing the combination in an acoustic mixer at about 10 to about 90% intensity, about 60 to about 65 Hz and about 1 to about 100 g for between about 3 minutes to about 10 minutes, and forming a uniform dispersion, where particles in the resulting dispersion have a $D_{50}$ of between about 150 nm to 210 nm.

DETAILED DESCRIPTION

The present disclosure provides processes for producing colorant dispersions which may be utilized to make EA toner. In embodiments, a process of the present disclosure includes low frequency, high intensity acoustic mixing of an organic or inorganic colorant to form colorant dispersions with particles having a small size and narrow particle distribution. In embodiments, the process requires a processing time of a few minutes and allows for high material yield from batch to batch and high capacity minimizing equipment, or material transfer, which is in contrast to methods which use piston-type and in-line rotor/stator-type homogenizers that require, for example, processing times of about four hours.

As used herein, "low frequency" means a frequency in the range from about 3 to about 300 Hertz (Hz).

As used herein, "acoustic intensity," means sound power, $P_{ac}$ per unit area, where P=root mean square (RMS) sound pressure; a=particle acceleration; and c=speed of sound.

As used herein, "acceleration," is the acceleration due to gravity, that is, 9.81 $m/s^2$.

As used herein, "high yield," or, "high material yields," means a colorant dispersion having a final colorant solids content of greater than about 50% of input colorant.

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating," and, "matching," or grammatic variations thereof, have generally acceptable definitions or at the least, are understood to have the same meaning as, "about."

Resins

Any resin may be utilized in processes using the pigment dispersions of the present disclosure to make toner. Such resins, in turn, may be made of any suitable monomer or monomers via any suitable polymerization method. In embodiments, the resin may be prepared by a method other than emulsion polymerization. In embodiments, the resin may be prepared by condensation polymerization.

In embodiments, the resin may be a polyester, polyimide, polyolefin, polyamide, polycarbonate, epoxy resin and/or copolymers thereof. In embodiments, the resin may be an amorphous resin, a crystalline resin, and/or a mixture of crystalline and amorphous resins. The crystalline resin may be present in the mixture of crystalline and amorphous resins, for example, in an amount of from 0 to about 50 percent by weight of the total toner resin, from 5 to about 35 percent by weight of the toner resin. The amorphous resin may be present in the mixture, for example, in an amount of from about 50 to about 100 percent by weight of the total toner resin, from 95 to about 65 percent by weight of the toner resin.

In embodiments, the polymer utilized to form the resin may be a polyester resin, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a polyol monomer with a polyester or polyacid monomer in the presence of an optional catalyst.

For forming a crystalline polyester, suitable diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments, from about 42 to about 55 mole percent, from about 45 to about 53 mole percent of the resin, although the amount can be outside of those ranges.

Examples of diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The diacid or diester may be selected in an amount of, for example, from about 40 to about 60 mole percent, from about 42 to about 55 mole percent, from about 45 to about 53 mole percent, although the amount can be outside of those ranges.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof and the like. Specific crystalline resins may be polyester based, such as poly(ethylene-adipate), polypropylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), and copoly (ethylene-fumarate)-copoly(ethylene-dodecanoate).

The crystalline resin can possess various melting points of, for example, from about 30° C. to about 120° C., from about 50° C. to about 90° C. although the melting point can be outside of those ranges. The crystalline resin may have a number average molecular weight (Mn), as measured by gel permeation chromatography (GPC) of, for example, from about 1,000 to about 50,000, from about 2,000 to about 25,000 (although the Mn can be outside of those ranges), and a weight average molecular weight (Mw) of from about 2,000 to about 100,000, from about 3,000 to about 80,000 (although the Mw can be outside of those ranges), as determined by GPC. The molecular weight distribution (Mw/Mn) of the crystalline resin may be from about 2 to about 6, from about 3 to about 4, although the Mw/Mn can be outside of those ranges.

Examples of diacid or diesters selected for the preparation of amorphous polyesters include dicarboxylic acids or diesters, such as, terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate and combinations thereof. The diacid or diester may be present, for example, in an amount from about 40 to about 60 mole percent of the resin, from about 42 to about 55 mole percent of the resin, from about 45 to about 53 mole percent of the resin, although the amount can be outside of those ranges.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene and combinations thereof. The amount of diol selected can vary, and may be present in an amount from about 40 to about 60 mole percent of the resin, from about 42 to about 55 mole percent of the resin, from about 45 to about 53 mole percent of the resin, although the amount can be outside of those ranges.

In embodiments, polycondensation catalysts may be used in forming the polyesters. Polycondensation catalysts which may be utilized for either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide or combinations thereof. Such catalysts may be utilized in amounts of, for example, from about 0.01 mole percent to about 5 mole percent based on the starting diacid or diester used to generate the polyester resin, although the amount can be outside of those ranges.

Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate) and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in entirety. Exemplary unsaturated amorphous polyester resins include, but are not limited to, poly(propoxylated bisphenol co-fumarate), poly(ethoxylated bisphenol co-fumarate), poly (butyloxylated bisphenol co-fumarate), poly(co-propoxylated bisphenol co-ethoxylated bisphenol co-fumarate), poly (1,2-propylene fumarate), poly(propoxylated bisphenol co-maleate), poly(ethoxylated bisphenol co-maleate), poly (butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and combinations thereof.

The amorphous resin can possess various glass transition temperatures (Tg) of, for example, from about 40° C. to about 100° C., from about 50° C. to about 70° C.

Examples of other suitable toner resins or polymers which may be utilized to form a toner in accordance with the present disclosure include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly (styrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

One, two or more toner resins may be used. In embodiments where two or more toner resins are used, the toner resins may be in any suitable ratio (e.g., weight ratio), such as, for instance, about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), from about 10% (crystalline resin)/90% (amorphous resin) to about 90% (crystalline resin)/10% (amorphous resin). In embodiments, the weight ratio of the resins may be from about 99% to about 90% of the amorphous resin, to from about 1% to about 10% of the crystalline resin.

In embodiments, a suitable toner of the present disclosure may include at least two amorphous polyester resins, a high molecular weight resin (HMW) and a low molecular weight resin (LMW). As used herein, an HMW amorphous resin may have an Mw of from about 35,000) to about 150,000, from about 45,000 to about 140,000, and an LMW amorphous resin may have an Mw of from about 10,000 to about 30,000, from about 15,000 to about 25,000.

In embodiments the resin may possess acid groups which, in embodiments, may be present at a terminus of a resin polymer. Acid groups which may be present include carboxylic acid groups and the like. The number of carboxylic acid groups may be controlled by adjusting the materials utilized to form the resin and reaction conditions.

In embodiments, the resin may be a polyester resin having an acid number from about 2 mg KOH/g of resin to about 200 mg KOH/g of resin, from about 5 mg KOH/g of resin to about 50 mg KOH/g of resin.

Surfactants

In embodiments, the process of the present disclosure includes adding a surfactant. Where utilized, a dispersion may include one, two or more surfactants. The surfactants may be selected from ionic surfactants and nonionic surfactants. Anionic surfactants and cationic surfactants are encompassed by the term, "ionic surfactants." In embodiments, the surfactant may be added as an aqueous solution with a concentration from about 40% to about 80% (pure surfactant) solids, from about 30% to about 70% solids of the dispersion.

Examples of nonionic surfactants that can be utilized for the processes illustrated herein and that may be included in the pigment dispersion are, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA520™, IGEPAL CA720™, IGEPAL CO-890™, IGEPAL CO-720™, IGEPAL CO-290™, IGEPAL CA-210198, ANTAROX 890™ and ANTAROX 897™. Other examples of suitable nonionic surfactants include a block copolymer of polyethylene oxide and polypropylene oxide, including those commercially available as SYNPERONIC PE/F, in embodiments. SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids, such as, abietic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of those surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the dispersion. In embodiments, a dispersant is combined with a colorant to form a dispersion as disclosed herein, for example, at a ratio of about 5:1, about 7:1, about 9:1, about 10:1, about 11:1, about 20:1, about 25:1, about 30:1 relative to the amount of added dispersant.

A colorant may be selected from the group consisting of a phthalocyanine-based pigment, insoluble azo-based pigment, azo lake-based pigment, anthraquinone-based pigment, quinacridone-based pigment, dioxazine-based pigment, diketopyrrolopyrrol-based pigment, anthrapyrimidine-based pigment, anthanthrone-based pigment, indanthrone-based pigment, flavanthrone-based pigment, perinone-based pigment, perylene-based pigment, thioindigo-based pigment, quinophthalone-based pigment and combinations thereof.

A colorant may be selected from the group consisting of carbon black, metal oxide, metal sulfide and metal chloride, titanium oxide, iron oxide, rouge, chromium oxide, Prussian blue, ultramarine blue, molybdate orange, black iron oxide, chrome yellow and combinations thereof.

As examples of suitable colorants, mention may be made of carbon black like REGAL 330®; magnetites, such as Mobay magnetites MO8029™, MO8060™; Colombian magnetites: MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. Colorants can be selected cyan, orange, violet, magenta, yellow, red, green, brown, blue or mixtures thereof. A colorant can be organic or inorganic.

Specific examples of colorants include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, and Anthrathrene Blue, identified in the Color Index as CI-69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (sanofi), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (sanofi), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann, CA), E.D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

In embodiments, the colorant dispersion may have a solids content of from about 10% to about 60%, from about 15% to about 55%, from about 15% to about 50%, from about 15% to about 45%, from about 30% to about 50%, from about 40% to about 45%.

In embodiments, the pigment dispersion may comprise particles having a $D_{50}$ of from about 10 nm to about 500 nm, from about 50 nm to about 500 nm, from about 100 nm to about 400 nm; from about 100 nm to about 450 nm; from about 150 nm to about 400 nm; from about 40 nm to about 400 nm; from about 30 nm to about 350 nm: from about 10 nm to about 250 nm; from about 10 nm to about 200 nm. The $D_{50}$ may be measured using a Nanotrac instrument (available from Microtrac, Montgomeryville, Pa.). In embodiments, the particle $D_{50}$ of the colorant dispersion has a standard deviation from about 0.02 to about 0.4, from about 0.025 to about 0.35, from about 0.03 to about 0.3, from about 0.04 to about 0.25.

In embodiments, the colorant is not pre-dispersed before mixing. In embodiments, no dispersant is used.

Dispersant

A dispersant can be a polymer or substance which can be surface active or not. A dispersant improves separation of particles in an emulsion or suspension. Any dispersant known in the art and which is compatible with colorant and toner can be used in the practice of the method of interest. For example, a resin, a polyester, a surfactant, a detergent, a solubilizer and so on can be used. More than one type of dispersant can be used.

Wax

Optionally, a wax may also be included with the resin emulsion, or combined with the resin and a pigment in forming toner particles. When included, the wax may be present in an amount of, for example, from about 1 weight percent to about 30 weight percent of the toner particles, from about 5 weight percent to about 25 weight percent of the toner particles.

Waxes that may be selected include waxes having, for example, a weight average molecular weight of from about 500 to about 20,000, from about 1,000 to about 10,000. Waxes that may be used include, for example, polyolefins, such as, polyethylene, polypropylene and polybutene waxes, such as, commercially available from Allied Chemical and Petrolite Corp., for example POLYWAX™ polyethylene waxes from Baker Petrolite, wax emulsions available from Michaelman, Inc. and the Daniels Products Co., EPOLENE N-15™, commercially available from Eastman Chemical Products, Inc., and VISCOL 550P™, a low Mw polypropylene available from Sanyo Kasei K.K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate: ester waxes obtained from higher fatty acid and monovalent or multivalent lower alcohol, such as, butyl stearate, propyl oleate, glyceride monostearate, glyceride distearate and pentaerythritol tetrabehenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate and cholesterol higher fatty acid ester waxes, such as, cholesteryl stearate. Examples of functionalized waxes that may be used include, for example, amines, amides, for example AQUA SUPERSLIP 6550™, SUPERSLIP 6530™, available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ also available from Micro Powder Inc., imides, esters, quaternary amines, carboxylic acids or acrylic polymer emulsion, for example, JONCRYL 74™, 89™, 130™, 537™ and 538™, all available from SC Johnson Wax, and chlorinated polypropylenes and polyethylenes available from Allied Chemical and Petrolite Corp. and SC Johnson wax. Mixtures of waxes may also be used.

Solvent

Any suitable organic solvent may be used to dissolve the resin, for example, alcohols, esters, ethers, ketones, amines and combinations thereof, in an amount of, for example, from about 30% by weight to about 400% by weight of the resin, from about 40% by weight to about 250% by weight of the resin, from about 50% by weight to about 100% by weight of the resin. The ratio of resin to solvent on a weight basis can be from about 10:3 to about 10:15, from about 10:4 to about 10:13, from about 10:5 to about 10:12. In embodiments, more than one solvent can be used. When two solvents are used, the ratio of the solvents can be from about 10:1 to about 1:10, from about 5:1 to about 1:5.

In embodiments, suitable organic solvents, sometimes referred to herein, in embodiments, as phase inversion agents, include, for example, methanol, ethanol, propanol, isopropyl alcohol (IPA), butanol, ethyl acetate, methyl ethyl ketone (MEK) and combinations thereof. In embodiments, the organic solvent may be immiscible in water and may have a boiling point of from about 30° C. to about 120° C.

Processing

As noted above, the present process includes acoustic energy mixing to produce a colorant dispersion. More than one colorant may be utilized. The colorant may be an organic pigment, an inorganic pigment or a combination thereof. In embodiment, one or more dispersants may be used.

Suitable acoustic mixers are within the purview of those skilled in the art. In embodiments, an acoustic mixer may include a closed vessel without impellers, which uses low-frequency, high intensity acoustic energy to provide the desired mixing.

Issues that may arise with the use of conventional mixers that possess impellers include, but are not limited to a moderate mixing cycle; limited high viscosity mixing capability; viscous heating; limited filler loading capability; high shear localized mixing; requires contact mixing and thus impeller cleaning is an additional step that must be utilized in the process; and the process includes mixing and transferring to a container, followed by use or storage.

To the contrary, advantages to be found by using an acoustic mixer include, but are not limited to, fast mixing cycle; excellent high-viscosity mixing capability; low heat generation; high rate of filler loading; high intensity mixing throughout the volume of material to be mixed; non-contact, hygienic, sealed mixing; and a shorter process, as mixing may occur in the container possessing the material, which is then used or stored.

The selected acoustic mixer in accordance with the present disclosure provides intimate mixing by applying a consistent shear field throughout the entire vessel, and thus, is suitable for mixing colorants.

In embodiments, a suitable acoustic mixer includes LABRAM mixers and RESONANT ACOUSTIC® mixers, without impellers, commercially available from Resodyn Acoustic Mixers. Inc. (Butte, Mont.). The acoustic mixer is operated on a resonant frequency. A closely controlled electromechanical oscillator is used to excite the mix material. The acoustic mixer may operate at a frequency of from about 3 Hertz (Hz) to about 300 Hz, from about 30 Hz to about 100 Hz, from about 60 Hz to about 65 Hz, from about 4 Hz to about 250 Hz, from about 5 Hz to about 200 Hz. The entire system may oscillate in resonance, allowing highly efficient energy transfer and rapid mixing of the components of the pigment dispersion. The device can operate at an intensity of from about 5 to about (10%, from about 10% to about 95%, from about 10% to about 90%, from about 15% to about 85%. The device may operate at an acceleration up to about 200 g, up to about 150 g, up to about 100 g.

Thus, in embodiments, the process of making the colorant dispersion may include mixing one or more colorants, an optional dispersant, an optional solvent and water in a vessel; and subjecting the mixture to acoustic mixing at a frequency of from, for example, about 3 Hz to about 300 Hz; forming a uniform colorant dispersion, wherein particles comprising said dispersion have a $D_{50}$ from about 50 nm to about 500 nm.

In embodiments, metal particles or bead may be included in the mixing step (e.g., about 1 mm to 3 mm stainless steel balls).

In embodiments, the acoustic mixing is carried out for less than 60 minutes, from about 1 minute to about 30 minutes, from about 1 to about 15 minutes, from about 1 minute to about 10 minutes, from about 4 minutes to about 5 minutes.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which resin particles are aggregated to the appropriate toner particle size and then coalesced to achieve the final toner particle size and morphology.

In embodiments, toner compositions may be prepared by emulsion aggregation processes, such as, a process that includes aggregating a mixture of a colorant, an optional wax and any other desired or required additives, and emulsions including the resins described above, optionally, in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 5. Additionally, in embodiments, the mixture may be homogenized by mixing at about 600 to about 6,000 revolutions per minute (rpm). Homogenization may be accomplished by any suitable means, including, for example, an IKA ULTRA TURRAX T50 probe homogenizer.

Following preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, an inorganic cationic aggregating agent, such as, polyaluminum halides, such as, polyaluminum chloride (PAC), or the corresponding bromide, fluoride or iodide, polyaluminum silicates, such as, polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate and combinations thereof. In embodiments, the aggregating agent may be added to the mixture at a temperature that is below the Tg of the resin.

Suitable examples of organic cationic aggregating agents include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$,$C_{15}$,$C_{17}$-trimethyl ammonium bromides, halide salts of quaternized polyoxyethylalkylamines, dodecylbenzyl triethyl ammonium chloride, combinations thereof and the like.

Other suitable aggregating agents also include, but are not limited to, tetraalkyl titinates, dialkyltin oxide, teraalkyltin oxide hydroxide, dialkyltin oxide hydroxide, aluminum alkoxides, alkyl zinc, dialkyl zinc, zinc oxides, stannous oxide, dibutyltin oxide, dibutyltin oxide hydroxide, tetraalkyl tin, combinations thereof and the like. Where the aggregating agent is a polyion aggregating agent, the agent may have any desired number of polyion atoms present. For example, in embodiments, suitable polyaluminum compounds have from about 2 to about 13, in embodiments, from about 3 to about 8, aluminum ions present in the compound.

The aggregating agent may be added to the mixture utilized to form a toner in an amount of, for example, from about 0.1% to about 10% by weight, from about 0.2% to about 8% by weight, from about 0.5% to about 5% by weight, of the resin in the mixture.

The particles may be permitted to aggregate until a predetermined desired particle size is obtained. Samples may be taken during the growth process and analyzed, for example, with a COULTER COUNTER, for average particle size. The aggregation thus may proceed by maintaining the elevated temperature, or slowly raising the temperature to, for example, from about 40° C. to about 100° C., and holding the mixture at that temperature for a time of from about 0.5 hours to about 6 hours, from about an hour to about 5 hours, while maintaining stirring, to provide the aggregated particles. Once the predetermined desired particle size is reached, an optional shell resin emulsion can be added to the emulsion comprising the nascent toner particles.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example, of from about 40° C. to about 90° C., from about 45° C. to about 80° C., which may be below the Tg of the resin as discussed above.

Shell Resin

In embodiments, after aggregation, but prior to coalescence, a resin coating may be applied to the aggregated particles to form a shell thereover. In embodiments, the core may thus include an amorphous resin and/or a crystalline resin, as described above. Any resin described above may be utilized as the shell. In embodiments, a polyester amorphous resin latex as described above may be included in the shell. In embodiments, the polyester amorphous resin latex described above may be combined with a different resin, and then added to the particles as a resin coating to form a shell.

In embodiments, resins which may be utilized to form a shell include, but are not limited to, a crystalline resin latex described above, and/or the amorphous resins described above. In embodiments, an amorphous resin which may be utilized to form a shell in accordance with the present disclosure includes an amorphous polyester, optionally in combination with a crystalline polyester resin latex described above. Multiple resins may be utilized in any suitable amounts. In embodiments, a first amorphous polyester resin may be present in an amount of from about 20% by weight to about 100% by weight of the total shell resin, from about 30% by weight to about 90% by weight of the total shell resin. Thus, in embodiments, a second resin may be present in an amount of from about 0% by weight to about 80% by weight of the total shell resin, from about 10% by weight to about 70% by weight of the shell resin.

The shell resin may be applied to the aggregated particles by any method within the purview of those skilled in the art. In embodiments, the resins utilized to form the shell may be in an emulsion including any surfactant described above. The emulsion possessing the resins, optionally the solvent based amorphous polyester resin latex neutralized with a base, such as, NaOH, described above, may be combined with the aggregated particles described above so that the shell forms over the aggregated particles.

The formation of the shell over the aggregated particles may occur while heating to a temperature of from about 30° C. to about 80° C., from about 35° C. to about 70° C. Formation of the shell may take place for a period of from about 5 minutes to about 10 hours, from about 10 minutes to about 5 hours.

The shell may be present in an amount of from about 10% by weight to about 40% by weight of the latex particles, from about 20% by weight to about 35% by weight of the latex particles.

Once the desired final size of the toner particles is achieved, the pH of the mixture may be adjusted with a base to a value of from about 3 to about 10, from about 5 to about 9. Adjustment of the pH may be utilized to freeze, that is to stop, toner growth. The base utilized to stop toner growth may include any suitable base, such as, for example, alkali metal hydroxides, such as, for example, sodium hydroxide, potassium hydroxide, ammonium hydroxide, combinations thereof and the like. In embodiments, a chelator, such as, ethylene diamine tetraacetic acid (EDTA), may be added to help adjust the pH to the desired values noted above.

In embodiments, the final size of the toner particles may be of from about 2 μm to about 12 μm, from about 3 μm to about 10 μm.

Coalescence

Following aggregation to the desired particle size and application of any optional shell, the particles may then be coalesced to the desired final shape, the coalescence being achieved by, for example, heating the mixture to a temperature of from about 45° C. to about 100° C., from about 55° C. to about 99° C., which may be at or above the Tg of the resins utilized to form the toner particles, and/or reducing the stirring, for example, to from about 1000 rpm to about 100 rpm, from about 800 rpm to about 200 rpm. Coalescence may be accomplished over a period of from about 0.01 to about 9 hours, from about 0.1 to about 4 hours.

After aggregation and/or coalescence, the mixture may be cooled to room temperature, such as, from about 20° C. to about 25° C. The cooling may be rapid or slow, as desired. A suitable cooling method may include introducing cold water to a jacket around the reactor. After cooling, the toner particles may be optionally washed with water and then dried. Drying may be by any suitable method for drying including, for example, freeze drying.

Additives

In embodiments, the toner particles may also contain other optional additives, as desired or required. For example, the toner may include positive or negative charge control agents, for example, in an amount of from about 0.1 to about 10 percent by weight of the toner, from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in entirety; organic sulfate and sulfonate compositions, including those disclosed in U.S. Pat. No. 4,338,390, the disclosure of which is hereby incorporated by reference in entirety; cetyl pyridinium tetrafluoroborates: distearyl dimethyl ammonium methyl sulfate; aluminum salts, such as, BONTRON E84™ or E88™ (Hodogaya Chemical); combinations thereof and the like.

There can also be blended with the toner particles external additive particles including flow aid additives, which additives may be present on the surface of the toner particles. Examples of additives include metal oxides, such as, titanium oxide, silicon oxide, tin oxide, mixtures thereof and the like; colloidal silicas, such as, AEROSIL®, metal salts and metal salts of fatty acids inclusive of zinc stearate, aluminum oxides, cerium oxides and mixtures thereof. Each of the external additives may be present in an amount of from about 0.1 percent by weight to about 5 percent by weight of the toner, from about 0.25 percent by weight to about 1 percent by weight of the toner. Suitable additives include those disclosed in U.S. Pat. Nos. 3,590,000 and 6,214,507, the disclosure of each of which hereby is incorporated by reference in entirety.

In embodiments, the dry toner particles, exclusive of external surface additives, may have the following characteristics:

(1) volume average diameter (also referred to as "volume average particle diameter") of from about 2 μm to about 12 μm, from about 3 μm to about 9 μm, from about 3.5 μm to about 7 μm;

(2) number average geometric size distribution (GSDn) of from about 1 to about 2, from about 1.1 to about 1.6, from about 1.15 to about 1.3, and/or volume average geometric size distribution (GSDv) of from about 1 to about 1.8, from about 1.1 to about 1.3, in embodiments, from about 1.15 to about 1.25; and (3) circularity from about 0.9 to about 1 (measured with a Sysmex FPIA 2100), from about 0.92 to about 0.99, from about 0.94 to about 0.97.

The characteristics of the toner particles may be determined by any suitable technique and apparatus. Volume average particle diameter, D50v, GSDv and GSDn may be measured by means of a measuring instrument such as a Beckman Coulter MULTISIZER 3.

Developers

The toner particles may be formulated into a developer. The toner particles may be mixed with carrier particles to achieve a two component developer composition. The toner concentration in the developer may be from about 1% to about 25% by weight of the total weight of the developer, from about 2% to about 15% by weight of the total weight of the developer.

Carriers

Examples of carrier particles that can be utilized for mixing with toner include particles capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as, polyvinylidene fluoride resins, terpolymers of styrene, methyl methacrylate, and/or silanes, such as, triethoxy silane, tetrafluoroethylenes, other known coatings and the like. The coating may have a coating weight of, for example, from about 0.1 to about 5% by weight of the carrier, from about 0.5 to about 2% by weight of the carrier.

In embodiments, suitable carriers may include a steel core, for example, of from about 25 to about 100 μm in size, from about 50 to about 75 μm in size, coated with about 0.5% to about 10% by weight, from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or xerographic processes, including those disclosed in U.S. Pat. No. 4,295,990, the disclosure of which is hereby incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

The following Examples are being submitted to illustrate embodiments of the present disclosure. The Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

PR 122 Magenta Pigment Dispersion using a Resonance Acoustic Mixer (RAM)

To a 250 ml plastic container were added 18.2 grams of PR122 magenta pigment powder, 2.73 grams of Tayca paste at 60% solids, and 25 grams of deionized water (DIW). The plastic container was sealed and placed in a Resodyn LabRAM mixer for 4 minutes at 90% intensity, 61.5 Hz and 91 g. Once mixed, the particle size was measured using a Nanotrac instrument. The PR122 pigment dispersion had a particle size of 206 nm with a standard deviation of 0.999 and a solids content of 43.0%.

Example 2

Regal 330 Pigment Dispersion Using a RAM

To a 250 ml plastic container were added 17.2 grams of Regal 330 pigment powder, 2.26 grams of Tayca paste at 64.5% solids, 27 grams of DIW and 21 grams of 3 mm stainless steel beads. The plastic container was placed in a Resodyn mixer for 5 minutes at 90% intensity. Once mixed, the particle size was measured using a Nanotrac instrument. The D50 particle size was 157 nm with a standard deviation of 0.0495.

Example 3

(Control) Regal 330 Pigment Dispersion Prepared with In-Line Rotor-Stator Homogenizer The pigment dispersion was carried out at a temperature of about 20° C. Before using the in-line Cavitron homogenizer to disperse the carbon black, the pigment had to be wetted in a surfactant solution to obtain a pigment concentrate containing approximately 36% solids. That operation was carried out using a Qudro ZA-1 powder dispersion device in a pre-dispersion loop. About 19.5 kg of TAYCAPOWER BN2060 anionic surfactant comprising primarily of branched sodium dodecyl benzene sulphonate at 60.0% solids and about 260 kg of DIW were charged into a 400 gal tank equipped with a side-mounted agitator and stirred at about 170 rpm for 40 minutes. A Lobe pump and a ZC-1 in the predispersion loop were turned on to circulate the solution and to facilitate surfactant dissolution. When the surfactant was completely dissolved, about 165 kg of R330 carbon black purchased from Cabot were added through the ZC-1 hopper. The aqueous mixture containing the pigment was then pumped through the ZC-1 at about 70 liters per minute for a period of about 30 minutes and then agitated at a speed of 280 rpm to mix for an additional 15 minutes. Ten kg of DIW were used to rinse the return line through the freshwater makeup line during the batch process. After the carbon black was predispersed, the process was moved from the pre-dispersion loop to the dispersion loop.

The dispersion process was initiated by turning on the Cavitron homogenizer so the pigment dispersion can circulate in the dispersion loop. A plate heat exchanger, downstream from the Cavitron in the dispersion loop, was used to control the dispersion temperature. During the dispersion step, the mixing was set to 40 rpm at the beginning and after 15 minutes, to 140 rpm. The dispersion process was carried out for about an hour. After completion of the dispersion process, 570 kg of DIW were charged into the tank to dilute the pigment concentrate to about 17% solids. The final product was filtered with a 50 μm filter bag. A 30 ml sample was taken and particle size was measured using a Nanotrac instrument. The R330 carbon black dispersion had a particle size of 139 nm with a standard deviation of 0.0446 and a solids content of 17.07%.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color or material.

We claim herein:

1. A process comprising:

mixing one or more colorants and water, with an optional dispersant, in a vessel to form a mixture;

subjecting the mixture to acoustic mixing at a frequency of from about 3 Hertz to about 300 Hertz; and forming a uniform aqueous colorant dispersion comprising colorant solids as particles, wherein said particles comprising said dispersion have a $D_{50}$ from about 50 nm to about 500 nm.

2. The process according to claim 1, wherein said one or more colorants is selected from the group consisting of a yellow pigment, magenta pigment, blue pigment, cyan pigment, green pigment, orange pigment, brown pigment, violet pigment, black pigment, white pigment, and combinations thereof.

3. The process according to claim 1, wherein said one or more colorants comprises an organic pigment or an inorganic pigment.

4. The process according to claim 1, wherein said one or more colorants is selected from the group consisting of a phthalocyanine-based pigment, insoluble azo-based pigment, azo lake-based pigment, anthraquinone-based pigment, quinacridone-based pigment, dioxazine-based pigment, diketopyrrolopyrrol-based pigment, anthrapyrimidine-based pigment, antbanethrone-based pigment, indanthrone-based pigment, flavanthrone-based pigment, perinone-based pigment, perylene-based pigment, thioindigo-based pigment, quinophthalone-based pigment and combinations thereof.

5. The process according to claim 1, wherein said one or more colorants is selected from the group consisting of carbon black, metal oxide, metal sulfide and metal chloride, titanium oxide, iron oxide, rouge, chromium oxide, Prussian blue, ultramarine blue, molybdate orange, black iron oxide, chrome yellow and combinations thereof.

6. The process according to claim 1, wherein said dispersion has a colorant solids content of about 10% to about 60%.

7. The process according to claim 1, wherein said one or more colorants is not predispersed before said mixing step.

8. The process according to claim 1, wherein acoustic mixing is carried out for about 1 minute to about 30 minutes.

9. The process according to claim 1, wherein said dispersion comprises a standard deviation of $D_{50}$ particle diameter distribution from about 0.02 to about 0.4.

10. The process according to claim 1, wherein said optional dispersant comprises a surfactant.

11. The process according to claim 10, wherein said surfactant is selected from the group consisting of anionic surfactants, nonionic surfactants, cationic surfactants, and combinations thereof.

12. The process according to claim 1, wherein said optional dispersant is present at a ratio of about 1:5 relative to the amount of the colorant.

13. The process according; to claim 1, wherein acoustic mixing occurs in an acoustic mixer lacking impellers.

14. The process according to claim 1, wherein said panicles comprise a D from about 40 nm to about 400 nm.

15. The process according to claim 1, wherein acoustic mixing comprises from about 60 Hz to about 65 Hz.

16. The process according to claim 1, wherein acoustic mixing comprises acceleration from about 1 to about 200 g.

17. The process according to claim 1, flintier comprising; adding metal beads at the mixing step.

18. The process according to claim 1, further comprising combining said aqueous colorant dispersion with at least one resin, an optional surfactant and an optional wax to form an emulsion; and producing toner particles from said emulsion.

19. The process according, to claim 18, wherein said at least one resin comprises a low molecular weight amorphous resin, a high molecular weight amorphous resin or both.

20. The process according to claim 18, wherein said at least one resin comprises a crystalline resin.

* * * * *